United States Patent [19]

Rawson

[11] 4,290,156

[45] Sep. 22, 1981

[54] OAR LOCK SEAT

[76] Inventor: Darwin B. Rawson, Rte. 1, Box 11, Butte, Mont. 59701

[21] Appl. No.: 65,043

[22] Filed: Aug. 9, 1979

[51] Int. Cl.[3] ..... B63B 17/00; B63B 29/00

[52] U.S. Cl. ..... 9/1.1; 9/1.7; 9/2 A; 9/7; 9/347; 440/106; 440/108; 440/109

[58] Field of Search ..... 9/1.1, 1.4, 1.7, 2 A, 9/7, 11 A, 347, 348; 115/24.1, 24.4, 24.5, 24.6; 43/55, 56; D6/64; D12/63, 70; 440/106, 108, 109

[56] References Cited

U.S. PATENT DOCUMENTS

| | | | |
|---|---|---|---|
| 2,299,178 | 10/1942 | Reiter | 9/7 |
| 2,557,972 | 6/1951 | Jewett | 9/7 |
| 3,694,835 | 10/1972 | Casey et al. | 9/2 A |
| 3,871,043 | 3/1975 | Davidson et al. | 9/7 |
| 3,958,289 | 5/1976 | Carlson | 9/1.1 |
| 4,063,320 | 12/1977 | Neumann et al. | 115/24.1 |
| 4,146,279 | 3/1979 | Stahel | 9/7 |

FOREIGN PATENT DOCUMENTS

| | | | |
|---|---|---|---|
| 1188972 | 3/1965 | Fed. Rep. of Germany | 9/2 A |
| 740233 | 11/1955 | United Kingdom | 9/2 A |

*Primary Examiner*—Charles E. Frankfort
*Attorney, Agent, or Firm*—Blair, Brown & Kreten

[57] ABSTRACT

Disclosed herein is an oar lock seat device that combines a sliding oar lock unit with an adjustable seat-cooler box. This apparatus is comprised of two gunnel mounted sliding oar lock assemblies structurally connected by an adjustable seat-carriage assembly whose unique construction encompasses an insulated storage box upon which the occupant sits. This apparatus fits securely into inflatable rafts of various dimensions and will remain with the craft even in an inverted position.

8 Claims, 3 Drawing Figures

OAR LOCK SEAT

BACKGROUND OF THE INVENTION

With the advent of increased interest in river rafting, a need exists for an oar lock seating device specifically designed to fit inflatable rafts or the like. Any such device must be able to cope with the rigorous conditions encountered while maneuvering rubber rafts through white water rapids and other adverse conditions. The positioning of the oars and the seat is critical to the oarsman's ability to control and maneuver his craft safely. The more tuneable these components are to the specific characteristics of the oarsman, then the more control the oarsman will have over his craft. However, it is inevitable that these rafts will occasionally capsize. In that event, the contents of the raft are likely to spill and be lost, unless they are firmly secured to the raft.

The following patents define structures which would appear to be germane to the patentability of this invention.

| | | | |
|---|---|---|---|
| 2,815,517 | Andresen Jr. | 3,898,950 | Martin |
| 3,825,962 | Grounds et al | 4,068,611 | Leather |
| 3,839,757 | Grimes | | |

The patent to Andresen teaches the use of a seat supported by the gunwales of the craft and having oar locks therein.

Likewise, Leather and Martin teach the use of oar locks integral with a removable seat.

The other two references further delineate the state of the art.

However, none of the aforementioned references is as adjustable or rugged as the present invention which was specifically designed with rigorous conditions in mind. This invention adjusts not only to fit different sized rafts, but also adjusts to fit different sized oarsmen and their varying preferences as to oar position in relation to seating position.

Furthermore, none of the aforementioned references incorporates a secure, insulated storage box integral to its structure as does the present invention.

SUMMARY AND OBJECTS OF THE INVENTION

Accordingly, this invention has as an object to provide an oar lock seat device that adjusts to fit the beam of various sized inflatable rubber rafts or like craft. This is accomplished by means of four transversely mounted structural bars that separate and secure the left and right oarlock assemblies.

Furthermore, another object of this invention is to provide adjustment in the seat carriage brackets to allow the height of the seat to be adjusted to fit various sized oarsmen. This allows each oarsman to maximize his efforts at safely controlling his craft because he can apply maximum leverage to the oars only when he is in the proper position to do so. This may make the difference between capsizing and remaining upright while white water rafting.

It is a further object of this invention to provide the oar lock assembly with a secure purchase on the gunwale of the raft affording the oarsman maximum control of his craft even in the most rigorous conditions. This is achieved by providing the foundation piece of the oar lock assembly with a rounded portion that fits the pontoon contour of the gunwale of an inflatable raft.

It is another object of the present invention to combine the adjustable seat with an insulated storage box providing the oarsman with the ability to adjust his seating position and store food and beverages in a container beneath his seat. Said box is firmly secured in the raft and provided with a latching lid so that if the raft were to capsize, the cache of food and supplies remains contained within the seat-cooler box.

These and other objects will become apparent in the following specification when considered in light of the attached drawing.

DESCRIPTION OF THE PREFERRED EMBODIMENT

Figure 1:
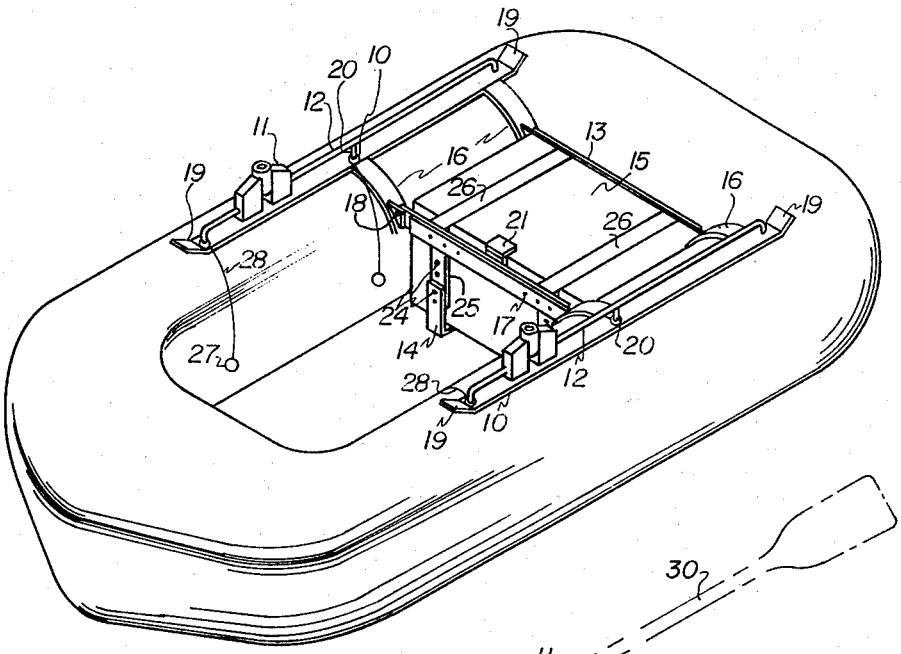
FIG. 1 is a perspective view of the oar lock seat device installed in a rubber raft.
Figure 2:
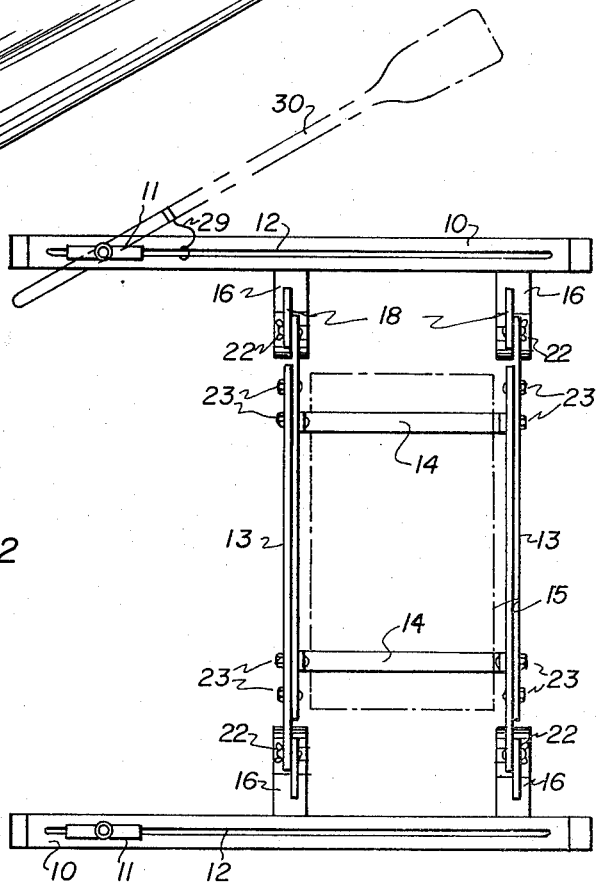
FIG. 2 is a top plan view of said device without the raft.
Figure 3:
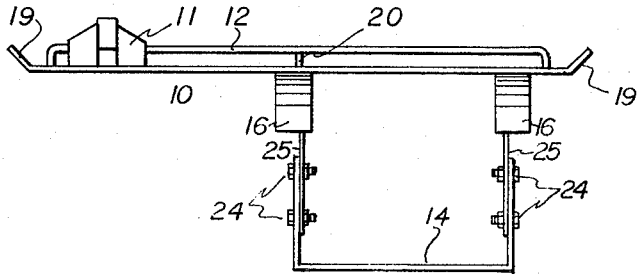
FIG. 3 is an end view thereof.

Referring in detail to the drawing, wherein like reference characters indicate like parts throughout the several figures, the reference numerals 10, 11 and 12 all refer to the oar lock assemblies of which there are two, a right and a left. Reference numeral 10 shows the foundation piece of the oar lock assembly. This piece 10 is a bar bent upwardly at the last two inches of either end 19 to prevent the ends from puncturing the raft during any extreme conditions. Also integral to the foundation piece 10, are two downwardly and inwardly curved contour pieces 16, which follow the contour of the pontoon shaped gunwale of an inflatable raft allowing a secure purchase of the device on the raft. Disposed on top of the foundation piece 10 is the oar receptacle track 12, a rod which runs through mounting holes in the oar receptacle 11 and terminates near the ends of the foundation piece 10. Said track 12 is bent 90° at either end and affixed to the upward face of the foundation piece 10 leaving the bottom face of the foundation piece 10 intact to prevent chafing. The track 12 is provided with an additional support piece 20 centrally located along the track 12 and firmly affixed by welds to the foundation piece 10 and the track 12. The oar receptacle 11 is comprised of two trapazoidal solid pieces affixed by welds or other means to either side of a hollow cylindrical sleeve which receives the oar lock with enough freedom to allow pivot. The oar receptacle 11 is mounted on the track 12 by means of horizontal holes provided in the receptacle 11. The receptacle 11 is securely affixed to the track 12 by welds in order to withstand the stresses of white water rafting.

Welded to the lower extremities of the contour pieces 16 is a triangular shaped mounting tab 18 which receives by means of bolts 22 the transversely mounted structural bars 13. These structural bars 13 appear in two pairs that are mounted parallel to one another linking the right and left oar lock assemblies. The structural bars 13 are provided with a plurality of matching adjustment slots 17 which when registered with one another are bolted through bolts 23 to secure the device in the proper adjustment setting.

Disposed underneath and supported by the structural bars 13 are the seat carriage brackets 14 of which there are two and the matching offset strip members 25 of which there are four. Each bracket 14 is an open ended rectangular bar provided with a plurality of matching adjustment slots 24. Said slots 24 when registered and bolted to the matching slots in the strip members 25 allow the seating position of the oarsman to be adjusted up or down thus affording him an opportunity to maximize his control over his craft by adjusting his seat to a position where he can exert maximum leverage if need be.

Disposed within the seat carriage brackets 14 is the combination seat and cooler box 15. This insulated storage box 15 upon which the oarsman sits is held securely within the seat carriage bracket 14 by nylon fastening strips 26 which are provided with holes at both extremities and is fastened by bolts and wing nuts to the structural bars 13. The cooler box 15 is also provided with a latch 21.

Since nearly all rubber rafts are provided with a series of mounting eyes, the present device is secured into the raft by six tie downs 28 that are provided at both ends and the middle of each oar receptacle track 12 and hook into the eyes in the raft 27.

In order to prevent loss of the oars, a quickly disconnect safety cord 29 is connected from the oar 30 to the oar receptacle track 12.

Having thus described the preferred embodiment of the invention it should be understood that numerous structural modifications and adaptations may be resorted to without departing from the spirit of the invention.

What is claimed is:

1. An oar lock seat device for use in inflatable rafts and the like comprising:

a left and right oar lock assembly means disposed on the top portions of the gunwales of the raft, transverse structural bars disposed in longitudinally spaced relationship within the upper portion of said raft and having opposite ends detachably connected to a respective one of said left and right oar lock assembly means, seat carriage bracket means extending from said transverse structural bars downwardly from and between said transverse structural bars within the interior of said raft to define with said transverse structural bars a recess for slidably accommodating a cooler seat box upon which an oarsman sits.

2. The device of claim 1 wherein said left and right oar lock assembly means comprise a foundation piece placed on the gunwale having upwardly turned extremities so as to not puncture the raft, an oar receptacle track defined by an elongated rod member having downwardly disposed terminal portions fastened to said foundation piece and an additional support piece centrally located along said oar receptacle track and likewise fastened to said foundation piece, and an oar receptacle disposed on said track and firmly affixed thereto.

3. The device of claim 2 in which said oar receptacle defines a cylindrical sleeve piece affixed between two trapazoidal solid pieces which are provided with horizontal holes running through the body of said trapazoidal solid pieces which receive said oar receptacle track and are affixed thereto.

4. The device of claim 3 including a foundation piece provided with downwardly and inwardly curving contour pieces conforming to the shape of the gunwale and interconnecting said foundation piece to said structural bars by means of a triangular mounting tab affixed to said contour pieces.

5. The device of claim 4 where said structural bars comprise two pairs of overlying offset bars, each pair of which interconnects by means of matching adjustment slots so as to adjust to rafts of different widths.

6. The device of claim 5 wherein said seat carriage brackets comprise a pair of open ended rectangular bars connected to said structural bars via a downwardly extending strip member having plural holes so as to adjust for rafts of different depths.

7. The device of claim 6 where said cooler seat box is disposed within a framework defined by said structural bars and said seat carriage brackets and includes a latch.

8. The device of claim 7 in which said structural bars, said strip members, said seat carriage brackets and said mounting tabs are connected by nuts and bolts.

* * * * *